United States Patent [19]

Rudolf

[11] 4,386,445

[45] Jun. 7, 1983

[54] DYNAMIC VACUUM CLEANING DEVICE

[76] Inventor: Alain Rudolf, 12 rue Vivienne, 75002 Paris, France

[21] Appl. No.: 267,694

[22] Filed: May 27, 1981

[30] Foreign Application Priority Data

May 27, 1980 [FR] France ..... 80 11668

[51] Int. Cl.[3] ..... A47L 5/18; A47L 5/20

[52] U.S. Cl. ..... 15/409; 15/341

[58] Field of Search ..... 15/409, 341

[56] References Cited

U.S. PATENT DOCUMENTS

| | | | |
|---|---|---|---|
| 1,040,612 | 10/1912 | Coyle | 15/409 X |
| 1,757,650 | 5/1930 | Arico | 15/341 X |
| 2,609,778 | 9/1952 | Bleam et al. | 15/409 X |
| 2,746,078 | 5/1956 | Spurlin | 15/409 X |
| 3,444,584 | 5/1969 | Cote | 15/409 X |
| 4,094,031 | 6/1978 | Cellini | 15/341 X |

*Primary Examiner*—Chris K. Moore

*Attorney, Agent, or Firm*—Barry R. Lipsitz

[57] ABSTRACT

A dynamic vacuum cleaning device permits continuous or intermittent extraction, aspiration and elimination of solid dusts and particles from a stationary or moving surface. The vacuum is created by forcing a gas at high velocity into a venturi. A tube extending from the venturi will have a negative pressure created therein, resulting in a suction. A brush may optionally be fitted to the end of the vacuum tube. An adjustable cam is provided to control the amount of suction. The device can be used for the vacuum cleaning of sensitive optical, phonic or delicate micromechanical apparatus.

8 Claims, 17 Drawing Figures

Fig. 5.
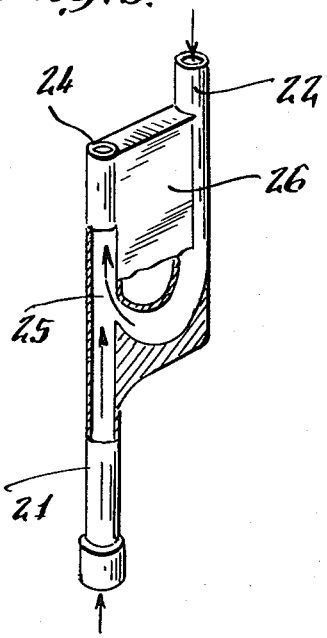
Fig. 6.
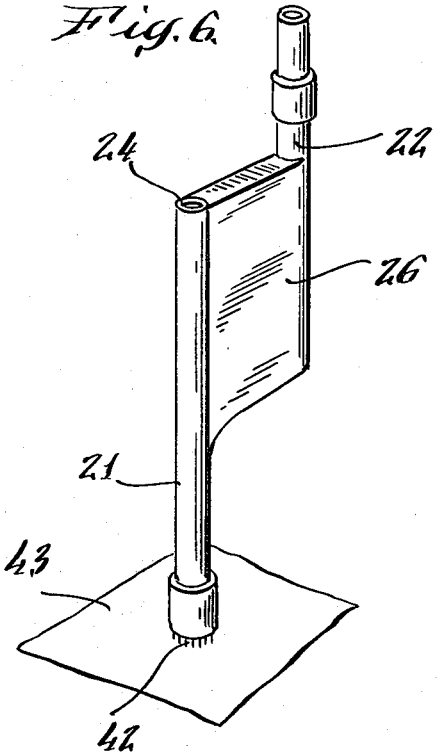
Fig. 7.
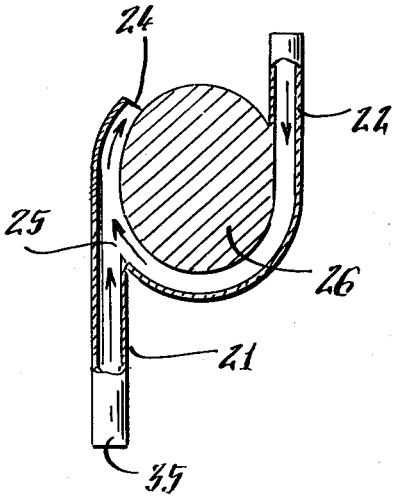
Fig. 9.
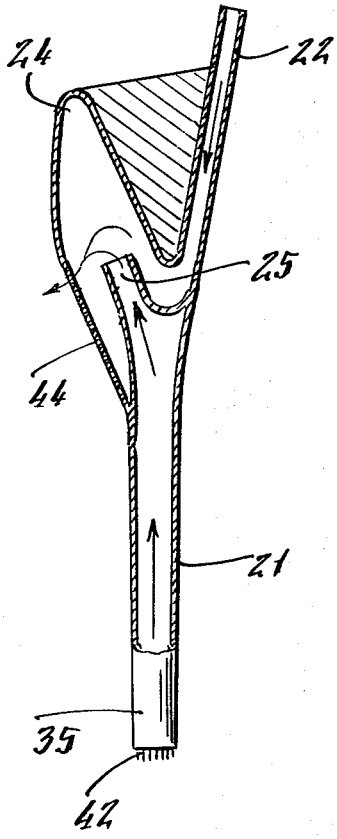
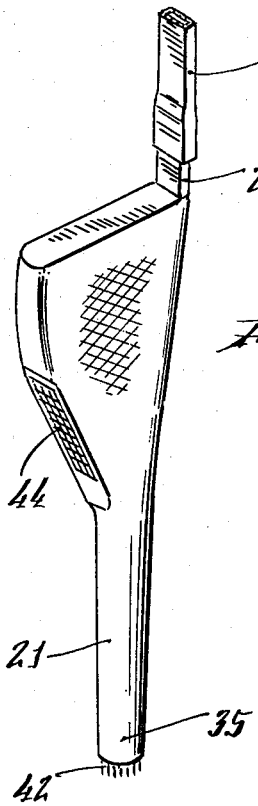
Fig. 10.
Fig. 8.
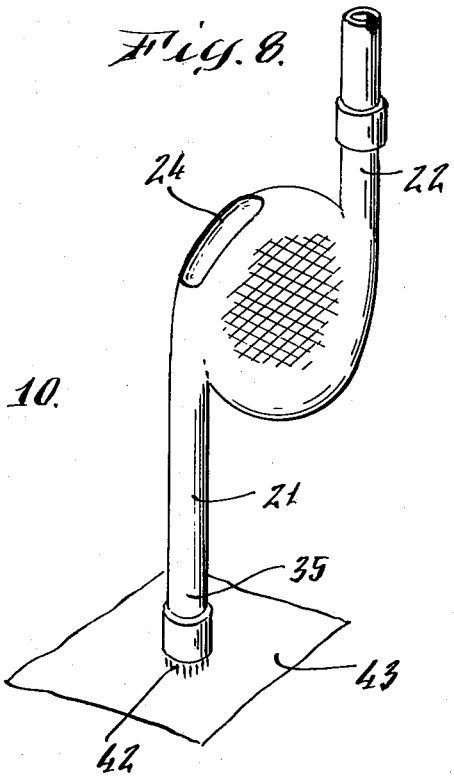

Fig. 11.
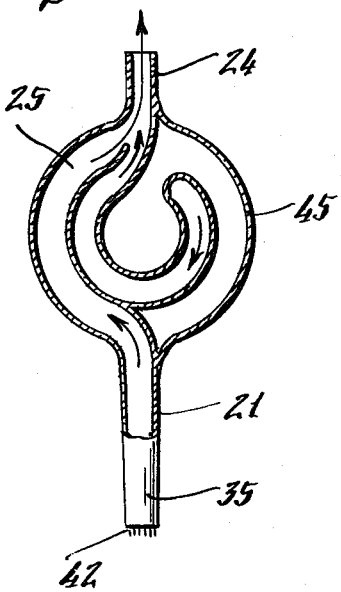
Fig. 12.
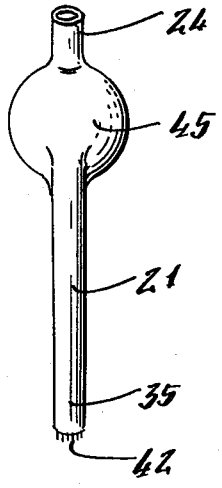
Fig. 13.
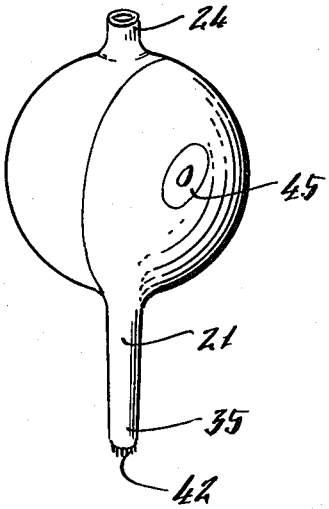
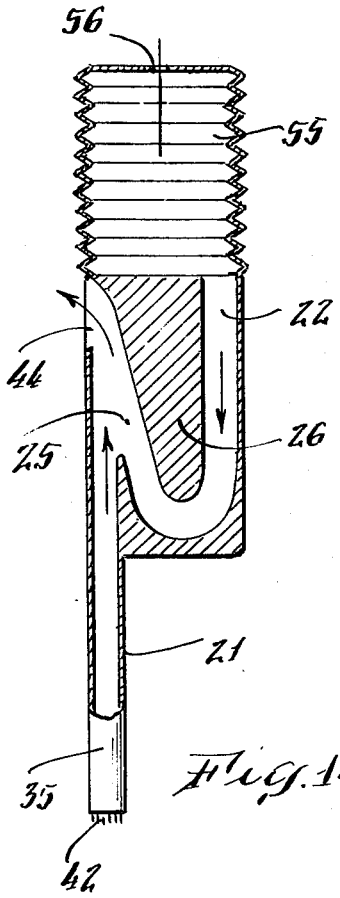
Fig. 14.
Fig. 15.
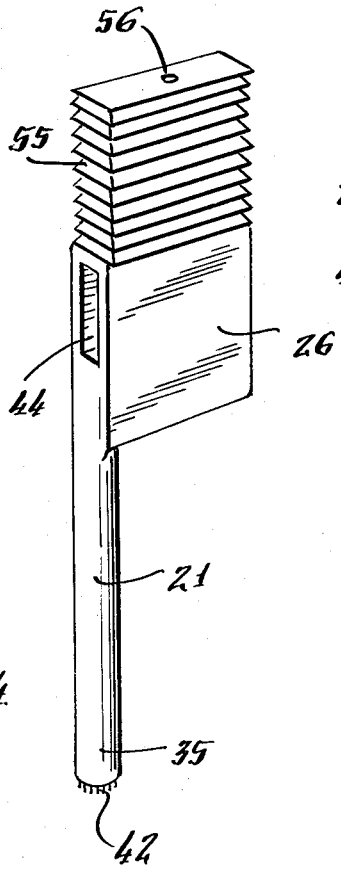
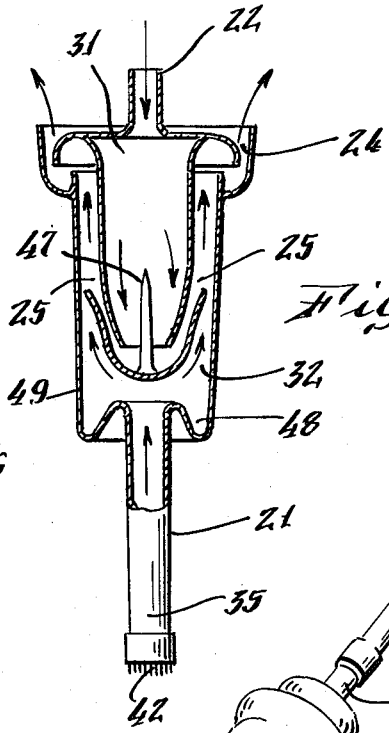
Fig. 16.
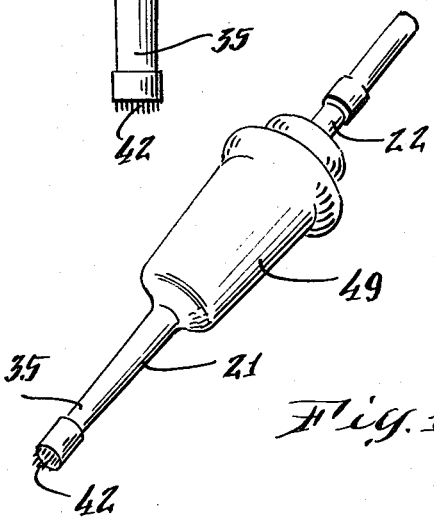
Fig. 17.

DYNAMIC VACUUM CLEANING DEVICE

BACKGROUND OF THE INVENTION

The present invention concerns a portable cleaning device using a dynamic vacuum cleaning system for continuously or intermittently extracting, aspirating and eliminating solid dusts and particles which have settled on a stationary or moving instrument.

It is well known that manually or electrically operated bag system aspirators may be used to remove particles which have settled on fragile optical or micromechanical apparatus. The aspiration is obtained either by using a pear-shaped rubber bag fitted with a tube, or with an electric aspirator which operates continuously. The aspirator may be fitted with a filter meant to collect the solid particles. Such cleaning devices work by creating a vacuum, the applied strength of which is determined both by the power of the source of aspiration and by the distance of the suction nozzle to the surface to be cleaned. The suction will be at its maximum with respect to the surface to be cleaned when the aspirating tube comes into contact with that surface. Such prior art systems create a rough, irregular operating action which is hard to control and which have a tendency to clog. Drawbacks of such systems are that the rough operating action can damage the apparatus to be cleaned. Further, it is very hard to control the aspiration and damage is occasionally done to the apparatus to be cleaned when loose elements are unintentionally withdrawn therefrom. In addition, the aspirator may become blocked, requiring changing of the filters. Still further, an irregular operating action is caused by the bag-type of aspiration or by the violence of electrical aspiration.

The present invention prevents the aforementioned drawbacks. The principle of the present invention is to inject air, another gas, or fluid into an adjustable "venturi" tube which produces a constant suction in a secondary tube used as an aspirator. In use, the apparatus of the present invention provides a gentle vacuum cleaning action. The amount of vacuum may be adjusted to accommodate the particular size particle which is sought to be removed from the dust or particle laden surface. The apparatus of the present invention also makes it possible to avoid damage to the materials to be cleaned and eliminates the problem of blockage or accumulation of dust in the aspiration device. Further, the present apparatus can be made of any metal or molded plastic material, resulting in a low manufacturing cost.

In accordance with the present invention, a vacuum cleaning device is provided. The device comprises a first tube having a source of gas or compressed air connected to one end thereof. The other end of said first tube is joined to an intermediate portion of a second tube and includes a "stem" or deflectable tongue which extends inside the second tube. The stem serves as a means for producing a venturi effect at the junction of the first and second tubes. The gas or compressed air entering the first tube exits from one end of the second tube, the venturi effect producting a vacuum at the other end of the second tube. The second tube may have a cleaning brush attached to the suction end thereof and a mechanical filter attached to the exit end thereof.

BRIEF DESCRIPTION OF THE DRAWINGS

A preferred embodiment of the present invention is described by reference to the accompanying drawings wherein:

FIGS. 5 and 6 show, respectively, a cutaway and perspective view of another embodiment of the present invention;

FIGS. 7 and 8 show, respectively, cutaway and perspective views of yet another embodiment;

FIGS. 9 and 10 show, respectively, cutaway and perspective views of a further embodiment;

FIGS. 11, 12 and 13 show, respectively, cutaway, end and perspective views of a different embodiment of the present invention;

FIGS. 14 and 15 show, respectively, cutaway and perspective views of another embodiment of the present invention; and FIGS. 16 and 17 show, respectively, cutaway and perspective views of one more embodiment of the present invention.

DETAILED DESCRIPTION

Figure 1:
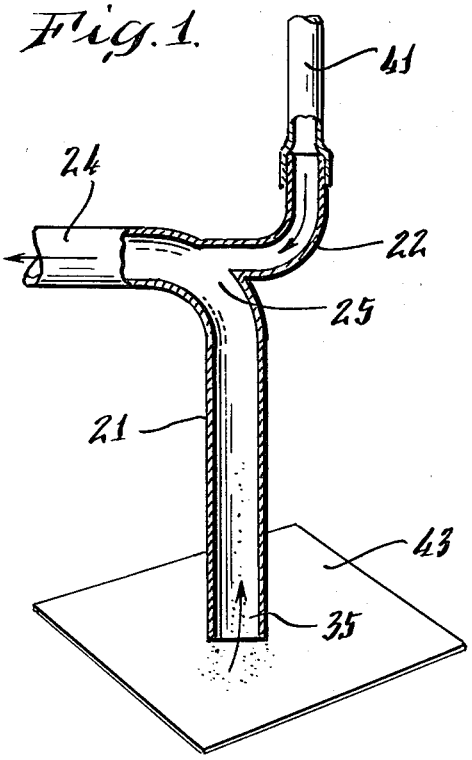
FIG. 1 shows the principle of operation of the apparatus.

As shown in FIG. 1, the vacuum cleaning device of the present invention comprises a first tube 22 joined to an intermediate portion of a second tube 21. A source of gas or compressed air (not shown) is connected to first tube 22 by hose 41. Tube 21 may be of the same, or larger diameter than tube 22. Joint 25, where tube 22 is connected to tube 21, forms a venturi that increases the velocity and lowers the pressure of the gas or compressed air flowing through it. Thus, when a flow of gas travels through tube 22, into and out of tube 21 at 24, a negative pressure is created in the area between joint 25 and suction end 35 of tube 21. This negative pressure creates a vacuum at suction end 35 of tube 21.

Figure 2:
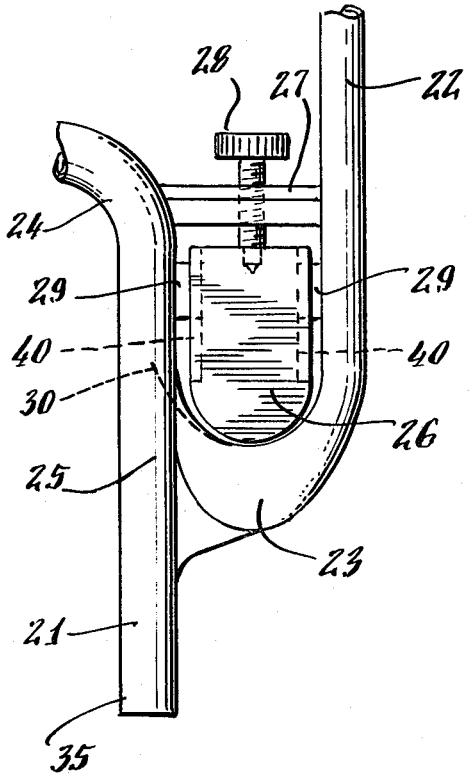
FIG. 2 is a cross-sectional view of one embodiment of the invention.
Figure 3:
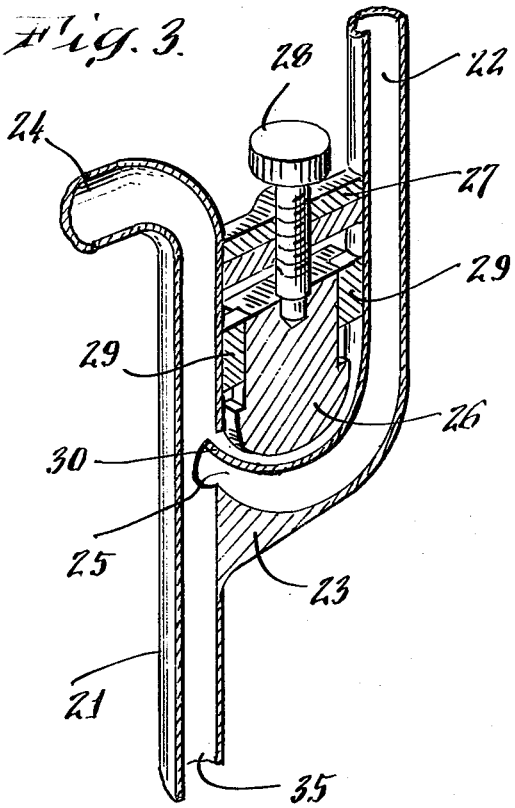
FIG. 3 is a perspective view of the embodiment shown in FIG. 2.
Figure 4:
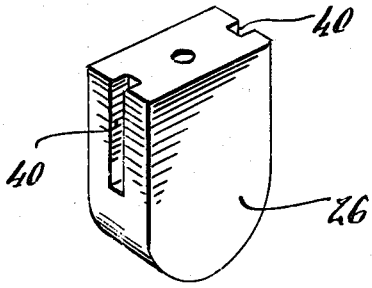
FIG. 4 is a perspective view of a cam for use in the embodiment of FIGS. 2 and 3.

As shown in FIGS. 2 through 4, the above-described principle is put into effect in an assembly comprising tubes 22 and 21 along with air flow adjusting cam 26. Cam 26 has slots 40 which are slidably engaged on rails 29. Cam 26 is driven by a threaded screw 28 which may be screwed and unscrewed within bracket 27. Bracket 27 is fixed in stationary relation to tubes 22 and 21. Thus, the screwing and unscrewing of screw 28 in bracket 27 will drive cam 26 up and down. Cam 26 is spherically shaped in the zone where it comes into contact with stem 30 and controls the orientation of stem 30. Stem 30 directs the air stream from tube 22 thereby creating a vacuum in tube 21 which sweeps the dusts which will be ejected outside the outlet 24. Thus, the combination of cam 26 and stem 30 provides an adjustable suction device. Frame member 23 provides support for the completed assembly.

FIGS. 5, 6, 7 and 8 represent alternate configurations of the vacuum cleaning device. In these embodiments, the arrangements of the tubes and cleaning accessories is varied. Brush 42 may be attached to the suction end of tube 21 to facilitate in the cleaning up of small particles. FIG. 6 represents the outside appearance of the apparatus of FIG. 5.

FIG. 7 shows the air flow principle of the vacuum cleaner according to the present invention. Tubes 21 and 22 meet at 25 to produce the venturi effect and create aspiration inside of tube 21. Tube 21 ends at its lower portion with a hairbrush 42 that just strokes the surface to be cleaned 43. In this embodiment, the apparatus is molded from plastic and cam 26 is permanently located in a non-adjustable position. The compressed air or gas which is introduced through hose 41 comes from a bag or an electric compressor and escapes at opening 24 loaded with solid particles issued from the cleaning surface 43. The outside appearance of the embodiment of FIG. 7 is shown in FIG. 8.

FIGS. 9 and 10 show yet another embodiment of the present invention. FIG. 9 shows the oblique junction of tubes 21 and 22 which constitutes a venturi chamber at level 25. The particles picked up at suction end 35 of tube 21 exit along with the compressed air or gas entering tube 22 from outlet 24. A removable mechanical filter 44 is mounted outside the tubular structure. This filter serves to recover the dusts picked up by suction end 35. FIG. 10 shows the external shape of the vacuum cleaner of FIG. 9. As shown in FIG. 10, a hairbrush 42 may be attached to suction end 35 of tube 21 to pick up any dust which clings to the surfaces to be cleaned.

FIGS. 11, 12 and 13 represent soft bag equipped designs of a vacuum cleaning device according to the principles of the present invention.

FIGS. 14 and 15 show an embodiment utilizing a bellows 55 with a one-way valve 56 for generating the required air flow. In the designs represented in FIGS. 11 through 15, the cam 26 has been definitely fixed, no provision having been made for user adjustment.

FIGS. 16 and 17 show a more elaborate vacuum cleaner equipped with a collector used to recover the solid particles vacuumed up.

Referring to FIG. 16, the air injected by tube 22 enters chamber 31 and meets at an intermediate portion of tube 21 in chamber 32 producing a venturi effect at point 25. The suction effect appears at the lower end 35 of tube 21, resulting in the attraction of the dusts to be eliminated. A portion of these dusts will escape at outlet 24. Heavier particles will be recovered at corner portions 48 of chamber 32 where a slight release effect occurs due to the differences of diameters which exist between this chamber and tube 21. FIG. 17 represents the cleaner of FIG. 16 in its cylindrical outside appearance equipped with hairbrush 42. In this embodiment, the vacuum cleaner may be constructed of either metal or plastic.

Turning now to FIGS. 1, 2 and 3, an example of the operation of the cleaning device according to the invention is given. The device is connected at the top of tube 22 to a source of air under pressure which can be obtained either by a bag or a compressor. For a given type of cleaning, and taking into account the fragile nature of the material to be cleaned, one can vary the pressure of pulsed air and the position of stem 30 by adjusting cam 26. Cam 26 is adjusted by screwing knurled screw 28 up or down. The vacuum obtained is then evaluated at suction end 35 of tube 21. The amount of suction can be varied by the user as desired. Once properly adjusted, suction end 35 of tube 21 is applied to the surface to be cleaned. The solid particles are aspirated and eliminated through outlet 24 and may be eventually collected on a filter or receptacle, not shown.

While the invention has been described in connection with a preferred embodiment, it is not intended to limit the scope of the invention to the particular forms set forth, but, on the contrary, it is intended to cover such alternatives, modifications and equivalents as may be included within the spirit and scope of the invention as defined by the appended claims.

I claim:

1. A vacuum cleaning device comprising:
a first tube having an input and an output end;
means for supplying a flow of gas to the input end of said first tube;
a second tube having a suction end and an exhaust end, said second tube being jointed at an intermediate portion thereof to the output end of said first tube;
means for providing a venturi effect at the junction of said first and second tubes, said means positioned to direct a flow of gas exiting from said first tube toward the exhaust end of said second tube,
said venturi effect producing a vacuum at the suction end of said second tube when gas is flowing through said first tube and exiting from said exhaust end, and
means for adjusting the orientation of gas exiting from said first tube to change the magnitude of the vacuum produced at said suction end.

2. The device of claim 1 further comprising brush means attached to said suction end for facilitating the vacuum removal of particles clinging to the surface of a material to be cleaned.

3. The device of claim 1 or 2 further comprising filter means coupled to said exhaust end for recovering solid particles picked up by said suction end.

4. The adjustment means of claim 1 comprising an adjustable cam driven by threaded screw means.

5. The device of claim 1 wherein said means for supplying a flow of gas comprises a hollow resilient bulb.

6. The device of claim 1 wherein said means for supplying a flow of gas comprises a compressor.

7. The device of claim 1 wherein said means for supplying a flow of gas comprises a bellows.

8. The device of claim 7 wherein said bellows includes a one-way valve.

* * * * *